United States Patent [19]

Summers

[11] Patent Number: 4,977,840

[45] Date of Patent: Dec. 18, 1990

[54] MINIMIZATION OF ENVIRONMENTAL WASTES

[75] Inventor: William A. Summers, Munster, Ind.

[73] Assignee: American Waste Reduction Corporation, Munster, Ind.

[21] Appl. No.: 410,386

[22] Filed: Sep. 20, 1989

[51] Int. Cl.[5] ..... F23G 5/12

[52] U.S. Cl. ..... 110/346; 48/209; 110/229; 110/230; 110/245; 110/341

[58] Field of Search ..... 110/229, 245, 341, 230, 110/346; 48/209

[56] References Cited

U.S. PATENT DOCUMENTS 4,308,034 12/1981 Hoang ..... 110/230
4,432,290 2/1984 Isitii et al. ..... 110/229 X
4,449,461 5/1984 Gorbulsky ..... 110/229
4,541,345 9/1985 Grumplet ..... 110/229
4,648,328 3/1987 Keough ..... 110/229
4,797,091 1/1989 Neumann ..... 110/229 X

*Primary Examiner*—Edward G. Favors
*Attorney, Agent, or Firm*—Philip Hill

[57] ABSTRACT

Industrial, municipal, sanitary, marine, and infectious waste materials are thermally and chemically converted principally to steam, fuels and environmentally acceptable solids by dehydration, pyrolysis of the solid residue therefrom, and finally gasification of the pyrolysis char residue. In contrast to incineration processes, the products have significant market value and present no atmospheric pollution problems. Temperatures employed range up to about 3000° F.

14 Claims, 1 Drawing Sheet

MINIMIZATION OF ENVIRONMENTAL WASTES

BACKGROUND OF THE INVENTION

This invention relates to an improved process for the effective minimization of waste materials while recovering therefrom an optimized proportion of fuel components and other useful products. The improved process of this invention employs both pyrolysis and gasification to achieve an environmentally desirable result.

Pollution of the environment has become a major problem in recent years and has now reached a state where conventional procedures for handling typical wastes are no longer adequate or even permissible. Increased concern for both working and living conditions has led to the enactment and enforcement of legislation intended, in part, to require disposal of waste materials, including harmful or hazardous waste materials, without causing additional pollution of the environment. Landfills are rapidly reaching the limits of their capacities and the generally suggested and preferred means for future processing usually involves incineration.

Major types of waste materials include a great variety of industrial wastes; municipal wastes and related sanitary wastes; hazardous wastes, including infectious wastes from hospitals; marine wastes; and agricultural wastes.

Typical hazardous waste materials include oily liquids such as polychlorinated biphenyls as well as various solid pesticide formulations and by-products such as dioxins as well as hospital wastes. Incineration has been practiced at sea as well as in various land-based operations. The latter include the co-firing of hazardous wastes in high-temperature industrial processes employing, for example, steel furnaces, cement kilns, lime kilns, and glass melting furnaces.

The complete incineration of waste material may be effected in a sub-surface cavity, as described in U.S. Pat. No. 4,438,708, either underground or under water. Liquid oxygen is supplied in excess so that ignition leads to complete destruction of the combustible material. Similarly, U.S. Pat. No. 4,077,337 relates to combustion of wastes in a closed room, employing pure oxygen to assure complete reaction. Waste coal in an abandoned mine may be combusted, as in U.S. Pat. No. 4,387,655, in a stream of air, with recovery of heat energy. Earlier art, relative to underground burning, includes various techniques for burning stumps, as, for example, U.S. Pat. Nos. 1,141,747; 1,190,006; 1,440,741; and 1,617,867.

U.S. Pat. No. 3,658,015 describes a submerged incinerator for burning oil residues from drill cuttings at an off-shore well-drilling location.

A portable incinerator is disclosed in U.S. Pat. No. 3,452,690, whereby radioactive waste is burned in a three-tier combustion assembly which can be placed over an ash pit.

In U.S. Pat. No. 3,768,424, solid waste material is pyrolyzed by heating in the absence of air at an unspecified temperature. Vaporized materials are then burned in air in the presence of a combustible gas such as propane.

In U.S. Pat. No. 4,253,406, pollution control is effected with a flueless combustion chamber wherein gaseous combustion products are diverted downwardly and finally through a standpipe. The combustion unit and downstream equipment are portable and can be used with part of the installation situated below grade.

U.S. Pat. No. 4,279,208 provides a method and apparatus for incineration of industrial wastes wherein the oxygen content of the combustion mixture is regulated by varying the feed rate of either air or pure oxygen, in a dual feed system, in response to a feedback signal indicating a parameter characteristic of the flue gas streams. In this manner, a selected oxygen content and a combustion temperature may be maintained.

In a gaseous combustion system, U.S. Pat. No. 4,038,032 provides for feedback control signals to regulate the proportion of combustible waste gas in the feed in order to avoid the presence of an explosive mixture.

Such combustion techniques typically create large additional quantities of carbon oxides, particularly carbon dioxide, which are discharged to an already polluted atmosphere. The typical oxidizing agent is air and, at typical combustion temperatures, the formation of various nitrogen oxides creates an additional pollution problem. All of this contributes in a major way to the worsening of the so-called "greenhouse effect" which threatens permanent deterioration of the environment.

Accordingly, there exists a serious need for the provision of improved waste processing methods which have the added advantage of generally improving the environment.

SUMMARY OF THE INVENTION

This invention provides for the pyrolysis and gasification of conventional waste materials, including domestic trash, farm wastes, municipal and sanitary wastes, a broad range of industrial wastes, and hazardous or infectious wastes originating, for example, in hospitals and the like. Pyrolysis temperatures up to about 1400° F. and gasification temperatures up to about 3000° F. are contemplated.

It is an object of this invention to effect minimization of conventional waste products while simultaneously providing means for the environmentally acceptable recovery of useful materials, including fuel components, chemical synthesis reagents, soil adjuvants, and the like.

It is a further object of this invention to provide means for the environmentally acceptable disposal of hazardous and toxic substances.

It is a still further object of this invention to provide an economical means for thermal decomposition of waste materials with minimal production of additional environmental pollutants.

DETAILED DESCRIPTION OF THE INVENTION

Figure 1:
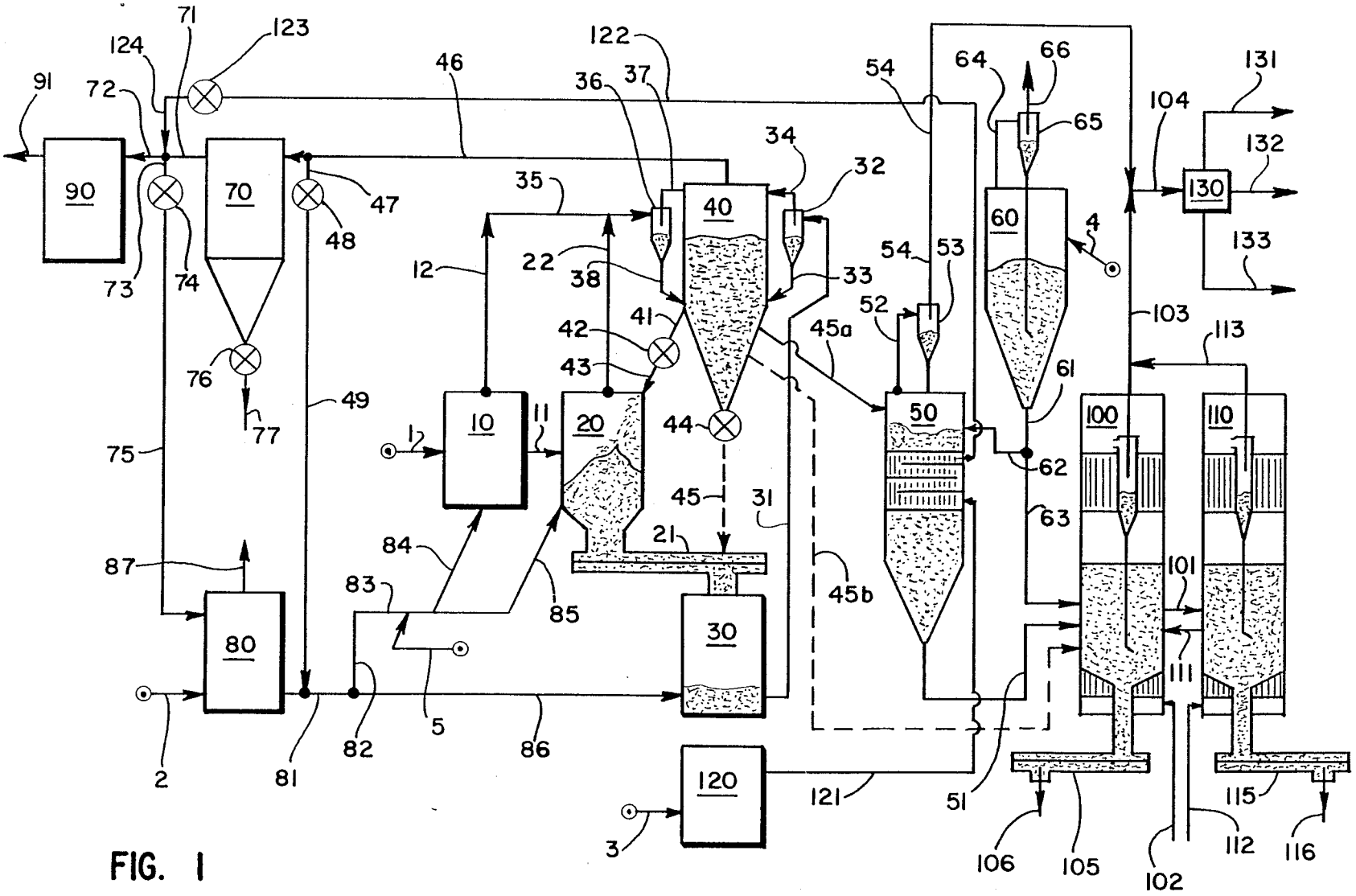
FIG. 1 presents a detailed diagram illustrating the flow patterns of one particular embodiment of this invention.

The process of this invention, in its various embodiments, provides an effective means for minimizing environmental wastes by the application of various thermal treatments which achieve a maximum recovery of useful products with a minimal production of atmospheric pollutants. As shown by certain embodiments of this invention, it is more practical to convert waste materials to clean fuel fractions than to incinerate the waste and clean up the resultant combustion products. The improved process of this invention employs a pyrolysis operation, and usually a succeeding gasification operation, to achieve the stated environmentally desirable ends.

The process of this invention is intended for application to the treatment of societal wastes generally, including industrial wastes of all types; agricultural wastes, including sanitary wastes; municipal wastes of all types, including sanitary wastes; marine wastes; and miscellaneous wastes, such as toxic or infectious wastes arising from the normal operation of hospitals or health clinics.

While some wastes include natural liquids, most liquid wastes require a drying step to remove substantially all water, whether present casually or liberated by thermal dehydration or chemical reaction. The presence of free water during a heating step is wasteful of heat so that additional fuel is required.

Dried and solid waste materials are heated and pyrolyzed most efficiently when in a finely ground and homogeneous state. The initial size of the waste material, its density, and its hardness may vary periodically so that there must be provision for shredding, crushing, grinding, or other comminuting operation. Particle size is preferably reduced in stages, as required, from, for example, large agglomerates, having a diameter of 6 inches or greater, to intermediate size masses, having a diameter in the range of about ½ inch, to powders, typically passing through a 20-mesh screen.

Heat for effecting the drying of the waste material, either before, after, or concurrent with the comminution operation, is typically supplied by combustion of a fuel gas stream with air or oxygen. The drying temperature may vary from about 240° F. to about 700° F., preferably from about 300° F. to about 500° F., with the higher temperatures being employed when large proportions of water are present or when various chemical hydrates must be destroyed.

Steam, light gases, and other vapors released during the heating step may be recycled or withdrawn from the system, preferably through a filter for recovery of fine solids. The stream may be employed in any available unit for heating, cogeneration, and the like. The dried solids are generally sent to heated storage pending further thermal conversion.

Pyrolysis of the comminuted, dried solid waste components is typically effected in a high-temperature pyrolysis vessel in the presence of steam, air, or oxygen at a temperature within the range from about 700° F. to about 1400° F., preferably from about 800° F. to about 1200° F. Pyrolysis gases and volatile liquids are withdrawn from the pyrolysis zone while remaining solids may be recovered, or, preferably, transferred to a gasification vessel for further reaction, typically in the presence of steam, air or oxygen. The gasification reaction is then effected at a temperature within the range from about 1400° F. to about 3000° F., preferably from about 1500° F. to about 2400° F. The gaseous effluent from the gasification zone chiefly comprises producer gas (principally carbon monoxide), or synthesis gas (principally carbon monoxide and hydrogen), and may be combined, if desired, with the gas stream from the pyrolysis step.

Both pyrolysis and gasification may be effected in fixed bed operations, although the preferred process steps involve fluidization of the solid bed particles with the incoming gas stream.

The solid product from the pyrolysis step typically comprises both char, from organic components of the waste, and ash, from the inorganic solids which are customarily present in most solid waste materials. Because of the more vigorous chemical conversion in the gasifier vessel, the solid product recovered from the highest temperature operations usually is principally ash. These higher temperatures also serve to destroy hazardous components such as dioxins and polychlorinated biphenyls.

The higher temperatures which may be employed in gasification will employ a slagging gasifier and yield a substantially carbon-free solid residual product.

Typically, the gaseous and liquid products from the pyrolysis and gasification operation consist of fuel components such as hydrocarbons, producer gas and carbon monoxide-hydrogen mixtures. Where the solid product includes char as a component, a fuel value may also be assigned to this fraction. Most significantly, these conversion products from solid waste materials are valuable and need not be consumed at the waste conversion site. They cause no pollution problems. Accordingly, the process of this invention is distinctly different from a conventional incineration process where the corresponding waste components are converted to carbon dioxide and other major pollutants, such as nitrogen oxides.

Where steam is recovered, it may be further employed for its heating value and finally recovered as a potable water stream for industrial use.

Recovered char may also find use as a fuel. However, other potential uses for the ash and ash-char products as, for example, soil adjuvants, suggest that a higher value should be assigned.

In some embodiments of this invention, the particular selection of waste material feedstocks may not require the more severe thermal treatment afforded by a gasifier. In such operations the solid residue will be substantially richer in carbon, or char.

FIG. 1 is exemplary, without limitation, of a particular embodiment of this invention wherein a selected mixture of solid and liquid wastes is processed to yield gaseous, liquid and solid fuel products together with a useful water stream and a steam effluent. The waste material may be industrial, agricultural, municipal, sanitary, infectious, marine, or any pertinent combination of these or other waste streams.

In accordance with this embodiment, the selected waste mixture is introduced through line 1 into heated storage vessel 10. The heated waste mixture is then passed through line 11 into shredder 20. Waste material is then passed first through screw conveyor 21 into crusher-grinder 30 and then through line 31 into cyclone 32. Solids pass through line 33 into separator-storage area 40. Any gases present are introduced into the upper section of vessel 40 through line 34.

Gases and vapors from vessels 10 and 20 are directed through respective lines 12 and 22 and finally through line 35 into cyclone 36. Gas-phase components are passed through line 37 into the upper section of vessel 40 while any entrained solids are accumulated in the cyclone 36 and introduced through line 38 to a midpoint of separator-storage area 40. Hot, comminuted solids may be recycled through line 41, valve 42, and line 43 to shredder 20 or through valve 44 and line 45 to screw conveyor 21.

Fuel gas and air are mixed and fed through line 2 to heater 80, for either direct or indirect heating, and combustion. Heated gases are delivered to vessels 10 and 20 through lines 81, 82, 83 and respective lines 84 and 85. Similarly, heated gas is supplied directly to vessel 30 through lines 81 and 86. The hot gas components from separator-storage area 40, which include a large proportion of steam and combustion gases, are separated from fine solids in cyclone 70 after transmission through line 46. This stream may be diverted by passage through line 47, valve 48, and line 49 for recycle through line 81. Alternatively, recycle may be effected after passage through cyclone 70 by means of lines 71, 73, valve 74, and line 75 to heater 80. Fine solids are recovered from cyclone 70 through valve 76 and line 77.

Substantially inert flue gas is removed from the system through line 87. Hot gas components may also be withdrawn through line 72, filter vessel 90, and line 91. These gases consist largely of steam and flue gas.

In this portion of the process system, the feed stream has been heated, crushed, ground to a desired particle size, dried, and made ready for subsequent processing at pyrolysis temperatures and, as desired, higher gasification temperatures.

Upon demand, hot solids are transferred to pre-heater 50 through line **45*a* or directly to pyrolysis vessel 100 through line 45*b*. Fuel gas and air are introduced through line 3 to heater 120 for combustion and the hot gases are sent to heat exchange tubes in pre-heater 50 through line 121. Fine coal particles may be introduced through line 4, coal bin 60, and lines 61 and 62. Flue gases from heater 120 eventually are transferred by line 122, valve 123, and line 124 to the manifold where they may either be recycled through line 73 or discharged through line 72**.

Gases that may accumulate in coal bin 60 are isolated by means of line 64 and cyclone separator 65 for discharge through line 66.

Solid waste components are transferred from vessel 40 through line **45*b* or from vessel 50 through line 51 to pyrolysis vessel 100. As required for temperature control, coal particles may be fed directly to vessel 100 from bin 60 by means of lines 61 and 63. As desired, further combustion and gasification may be effected in gasifier vessel 110 by transfer of reactants through line 101. Temperature control may be improved by recycle of solids to the pyrolysis zone through line 111. Steam, air, or oxygen, as selected, may be introduced into the reaction vessels 100 and 110 through respective lines 102 and 112. Gaseous and liquid products from lines 54, 103 and 113 are combined in line 104, passed through a cooler (not shown), and sent to separation zone 130 for recovery of oil and tar, water, and fuel gas through respective lines 131, 132, and 133. Where the oil-tar product may contain components that have not been subjected to the highest processing temperatures, and thus may contain some toxic compounds, this product may be cycled to gasifier 110** through appropriate lines (not shown).

Where heat processing has been controlled to form a char product, it is recovered through screw conveyors 105 and 115, followed by lines 106 and 116. Where heat treatment is selected to be more severe, the only solid product will be an ash fraction.

Whenever a waste stream comprises toxic infectious components, suitable inoculants or germicides are injected into the stream early in the processing procedure, preferably through line 5 so that a detoxifying action can occur in either or both of vessels 10 and 20.

In the special case of hospital, or infectious, waste materials, a typical composition consists of 64 wt.% hospital rubbish, 12 wt.% food wastes, and 24 wt.% non-combustible solids. Organic materials include chiefly cellulose, together with much smaller amounts of oils, protein, and plastics. One ton of such waste should, when converted in accordance with the process of this invention, yield about 34 wt.% steam, 7.5 wt.% carbon monoxide, 2 wt.% methane, 0.5 wt.% hydrogen, 13 wt.% oil and tar, and 11.% carbon. The remainder consists of carbon dioxide and inorganic ash.

I claim:

1. An improved process for the conversion of environmental waste streams to useful and desirable products, comprising the steps of:

a) heating an environmental waste stream at a first elevated temperature within the range from about 240° to about 700° F., whereby dehydration occurs and moisture and dissolved gases are liberated therefrom to afford a dried waste stream feed material;

b) comminuting the dried waste stream feed material;

c) pyrolyzing the comminuted, dried waste stream feed material at a second elevated temperature within the range from about 700° to about 1400° F., whereby pyrolytic liquid and gaseous fractions are liberated to afford a waste stream solid residue, substantially comprising char and ash;

d) gasifying the waste stream solid residue at a third elevated temperature within the range from about 1400° to about 3000° F., whereby additional liquid and gaseous fractions are liberated to afford a solid residue product, substantially comprising ash;

e) recovering the solid residue product; and f) separately recovering the pyrolytic liquid and gaseous fractions and the additional liquid and gaseous fractions.

2. The process of claim 1 wherein the pyrolytic liquid and gaseous fractions and the additional liquid and gaseous fractions are combined and thereafter separated into oil and tar, water, and fuel gas products.

3. The process of claim 1 wherein the environmental waste stream is selected from the class consisting of industrial, agricultural, municipal, marine, infectious, and sanitary wastes, and mixture thereof.

4. The process of claim 1 wherein the environmental waste stream is heated to a first elevated temperature within the range from about 300° to about 500° F.

5. The process of claim 1 wherein the pyrolizing step is conducted at a second elevated temperature within the range from about 800° to about 1200° F.

6. The process of claim 1 wherein the gasifying step is conducted at a third elevated temperature within the range from about 1500° to about 2400° F.

7. The process of claim 1 wherein the comminution of the dried waste stream feed material is effected by selected shredding, crushing, and grinding steps.

8. The process of claim 1 wherein the environmental waste stream comprises at least an infectious waste stream and said stream is treated with a germicidally active material prior to and during the heating step at the first elevated temperature.

9. The process of claim 1 wherein the respective temperature ranges are achieved, at least in part, by combustion of an external fuel gas stream with an oxidation agent selected from the class consisting of air, oxygen, and mixtures thereof.

10. The process of claim 1 wherein the pyrolyzing step is conducted under fluidizing conditions.

11. The process of claim 1 wherein the gasifying step is conducted under fluidizing conditions.

12. The process of claim 1 wherein each of the pyrolyzing and gasifying steps is conducted under fluidizing conditions.

13. The process of claim 1 wherein the separately recovered pyrolytic liquid fraction is subsequently subjected to gasification at a temperature within the range from about 1400° to about 3000° F.

14. An improved process for the conversion of an infectious waste stream to useful and desirable products, comprising the steps of:

a) treating the infectious waste stream with germicidally active material;

b) heating the germicidally treated infectious waste stream at an elevated temperature within the range from about 240° to about 700° F., whereby dehydration occurs and moisture and dissolved gases are liberated therefrom to afford a dried, germicidally treated waste feed material;

c) comminuting the dried, germicidally treated waste feed material;

d) pyrolyzing the comminuted, dried, germidically treated waste feed material at an elevated temperature within the range from about 700° to 1400° F., whereby pyrolytic liquid and gaseous fractions are liberated to afford a waste stream solid residue, substantially comprising char and ash; and e) separately recovering the liberated gaseous and liquid fractions and waste stream solid residue.

* * * * *